US010059416B2

(12) United States Patent
Shomura et al.

(10) Patent No.: US 10,059,416 B2
(45) Date of Patent: Aug. 28, 2018

(54) ENGINE FOR OUTBOARD MOTOR

(71) Applicant: SUZUKI MOTOR CORPORATION, Hamamatsu-Shi, Shizuoka (JP)

(72) Inventors: Nobuyuki Shomura, Hamamatsu (JP); Toshio Hayashi, Hamamatsu (JP); Tomohiko Miyaki, Hamamatsu (JP); Ryuji Hamada, Hamamatsu (JP)

(73) Assignee: Suzuki Motor Corporation, Hamamatsu-Shi, Shizuoka (JP)

( * ) Notice: Subject to any disclaimer, the term of this patent is extended or adjusted under 35 U.S.C. 154(b) by 89 days.

(21) Appl. No.: 15/180,777

(22) Filed: Jun. 13, 2016

(65) Prior Publication Data

US 2016/0368580 A1 Dec. 22, 2016

(30) Foreign Application Priority Data

Jun. 16, 2015 (JP) ..... 2015-121329

(51) Int. Cl.
*B63H 20/00* (2006.01)
*B63H 20/24* (2006.01)

(52) U.S. Cl.
CPC ..... *B63H 20/24* (2013.01); *F01N 2550/14* (2013.01); *F01N 2590/021* (2013.01)

(58) Field of Classification Search
CPC ..... B63H 20/24; B63H 20/245; F01N 3/326; F01N 2550/14; F01N 2590/021; F01N 2610/08; F01N 2610/085
See application file for complete search history.

(56) References Cited

U.S. PATENT DOCUMENTS 5,408,829 A * 4/1995 Woodward ..... F01N 3/32 440/89 H
5,554,057 A * 9/1996 Abe ..... B63H 20/245 440/89 H
5,730,632 A * 3/1998 Murata ..... F01N 3/28 440/88 R
8,062,084 B2 * 11/2011 Konakawa ..... B63H 20/245 440/89 R
8,142,247 B2 * 3/2012 Konakawa ..... F01N 3/10 440/89 H
9,816,423 B2 * 11/2017 Shomura ..... F01P 5/04
9,909,479 B2 * 3/2018 Shomura ..... F01N 3/32
2010/0056001 A1 3/2010 Konakawa et al.

FOREIGN PATENT DOCUMENTS

JP 2010053771 A 3/2010

* cited by examiner

*Primary Examiner* — Ajay Vasudeva
(74) *Attorney, Agent, or Firm* — Troutman Sanders LLP

(57) ABSTRACT

An engine for an outboard motor is provided with an engine body, an intake system configured to supply combustion air to the engine body, an exhaust passage formed by connecting the engine body and middle and lower units thereunder, a catalyst provided in the exhaust passage, and an air pump configured to supply secondary air to an upstream side of the catalyst. The intake system is arranged in a side portion of one side of the left or right side of the engine body, and the exhaust passage and the air pump are arranged in a side portion of the other side of the left or right side of the engine body.

7 Claims, 9 Drawing Sheets

ENGINE FOR OUTBOARD MOTOR

CROSS-REFERENCE TO RELATED APPLICATIONS

This application is based upon and claims the benefit of priority of the prior Japanese Patent Application No. 2015-121329, filed on Jun. 16, 2015, the entire contents of which are incorporated herein by reference.

BACKGROUND OF THE INVENTION

Field of the Invention

The present invention relates to an engine for an outboard motor, and more particularly, to an engine for an outboard motor suitable for a catalyst-mounted model.

Description of the Related Art

An outboard motor mounted on a small boat and the like is configured such that an upper-unit and a guide exhaust are connected to an upper-part of a lower-unit provided with a propeller, an engine is supported and fixed on the guide exhaust, the engine is covered by an engine cover, and a propeller is rotated and driven by the engine. An exhaust gas output from the engine is discharged to the seawater through an exhaust passage vertically provided on the side face of the engine across upper and lower units.

In such an engine for an outboard motor, a catalytic converter may be provided in the exhaust passage in order to purify the exhaust gas and comply with an exhaust gas control requirement in some cases. Furthermore, an air pump configured to supply secondary air to the exhaust passage is provided in order to supply oxygen necessary to detoxify the exhaust gas by oxidizing hydrocarbons and carbon monoxides in the exhaust system.

For example, Japanese Laid-open Patent Publication No. 2010-53771 discusses an outboard motor provided with an air pump supported by an engine to supply secondary air to the upstream side of the catalytic converter in the middle of the exhaust passage. An air inlet port (air inlet hole) of the air pump is opened in a position higher than the engine inside a cowling in order to prevent water from mixing to the secondary air supplied by the air pump to the exhaust passage.

Patent Document 1: Japanese Laid-open Patent Publication No. 2010-53771

In general, an engine, an intake system, and an exhaust system of an outboard motor are housed in an engine housing covered by a cowling which is an engine cover. It is not easy to arrange accessories such as a catalytic converter or an air pump in addition to the intake and exhaust systems within a limited space of the engine housing. That is, a limitation inevitably exists in arrangement due to a relationship with neighboring components. It is difficult to compactly arrange a plurality of functional devices or components while the exhaust gas purification functionality is reliably obtained. In practice, this results in a size increase of the outboard motor.

SUMMARY OF THE INVENTION

In view of the aforementioned problems, it is therefore an object of the present invention to provide an engine for an outboard motor capable of effectively and suitably achieving compactification.

According to an aspect of the invention, there is provided an engine for an outboard motor including: an in-line multiple cylinder engine body provided with a crankshaft having an axial line directed to a vertical direction and a plurality of vertically overlapping cylinders, the cylinders having axial lines directed backward in a horizontal direction; an intake system configured to supply combustion air to the engine body; an exhaust passage formed to connect the engine body and middle and lower units thereunder; a catalyst provided in the exhaust passage; and an air pump configured to supply secondary air to an upstream side of the catalyst in the exhaust passage, wherein the intake system is arranged in a side portion of one side of the left or right side of the engine body, and the exhaust passage and the air pump are arranged in a side portion of the other side of the left or right side of the engine body.

In the engine for an outboard motor according to the invention, the exhaust passage may have an exhaust manifold that is connected to exhaust ports provided in each cylinder of the engine body and extends in a vertical direction, a catalyst housing portion arranged in parallel with the exhaust manifold to house the catalyst, and a connection passage configured to connect the exhaust manifold and the catalyst housing portion, the air pump may be arranged in a front side of the engine body relative to the exhaust manifold and the catalyst housing portion, and a connecting portion for connection from the air pump to the secondary air supply passage may be provided in any one of the exhaust ports of each cylinder, the exhaust manifold, and the connection passage and be connected to the secondary air supply passage in an upstream side relative to the catalyst housing portion in an exhaust flow direction.

In the engine for an outboard motor according to the invention, the catalyst housing portion may be arranged in a rear side of the engine body relative to the exhaust manifold.

In the engine for an outboard motor according to the invention, the air pump may be connected to the crankshaft by interposing a power transmission device and be driven by the crankshaft, and the power transmission device may have a clutch mechanism capable of controlling transmission of a driving force.

In the engine for an outboard motor according to the invention, the connecting portion of the secondary air supply passage may be formed integrally with the cylinder block included in the engine body and be provided with a communicating passage communicating with each exhaust port of each cylinder.

In the engine for an outboard motor according to the invention, a connecting portion of the exhaust passage for connection to the secondary air supply passage may be formed in the most upstream side of the exhaust manifold in the exhaust flow direction.

In the engine for an outboard motor according to the invention, the connection passage for connecting the exhaust manifold of the exhaust passage and the catalyst housing portion may have an upright portion that extends upward from a lower part of the exhaust manifold and is connected to a top portion of the catalyst housing portion, and a connecting portion for connection to the secondary air supply passage may be formed approximately in the most upstream side of the connection passage in the exhaust flow direction.

In the engine for an outboard motor according to the invention, the engine body and the intake and exhaust systems thereof may be housed in an engine housing covered by an engine cover, an opening of an external air guide unit for receiving external air to the inside of the engine housing may be provided behind the engine body in a rear part of the engine housing, and an inlet port of the air pump may be set vertically higher than an opening of the external air guide unit in a front part of the engine housing.

DETAILED DESCRIPTION OF THE PREFERRED EMBODIMENTS

An engine for an outboard motor according to preferred embodiments of the present invention will now be described with reference to the accompanying drawings.

Figure 1:
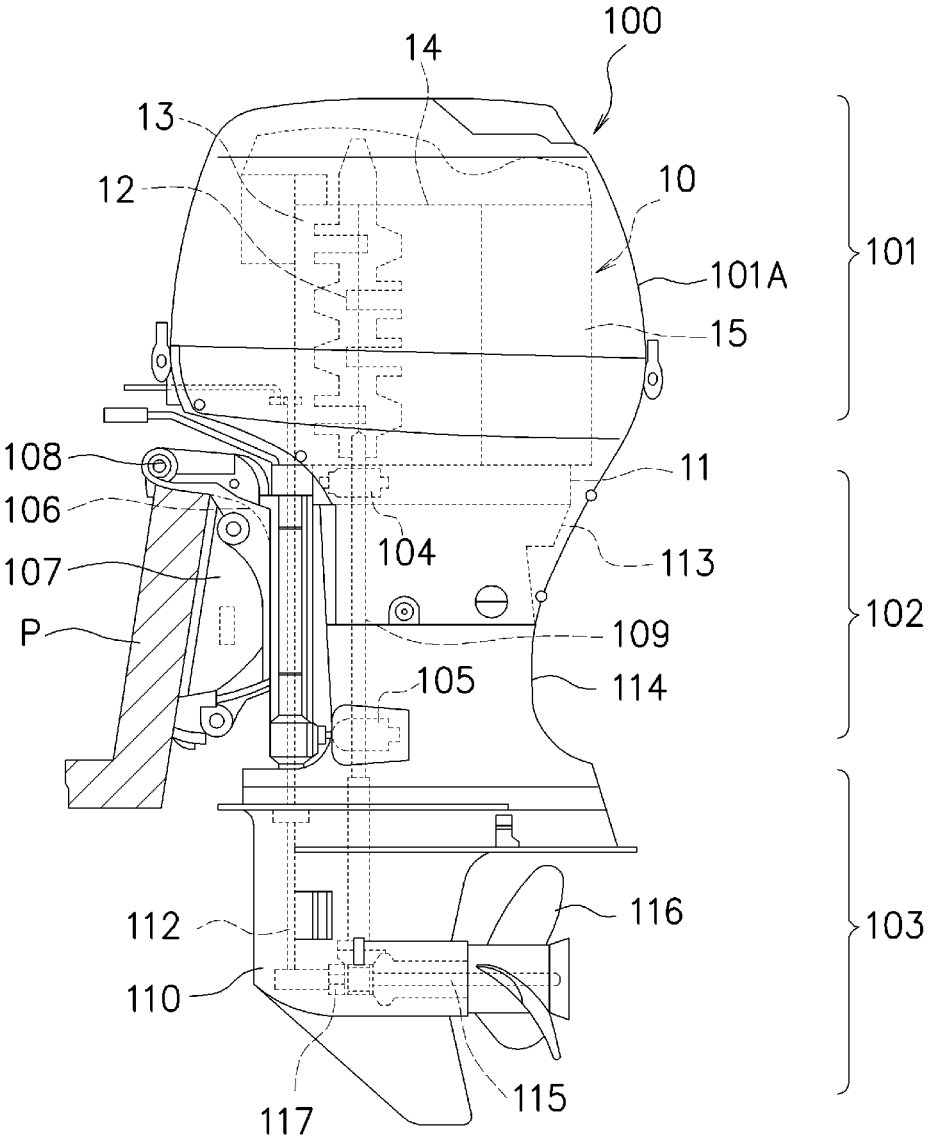
FIG. 1 is a left side view schematically illustrating an exemplary whole structure of an outboard motor according to a first embodiment of the invention.

FIG. 1 is a left side view schematically illustrating an exemplary structure of an outboard motor 100 according to the invention. In this case, a front side of the outboard motor 100 is fixed to a transom P of a ship hull as illustrated in FIG. 1. It is noted that, in the following description for each drawing, the arrow Fr denotes a front side of the outboard motor 100, the arrow Rr denotes a rear side of the outboard motor 100, the arrow R denotes a right side of the outboard motor 100, and the arrow L denotes a left side of the outboard motor 100 as necessary.

<First Embodiment>

In the entire configuration of the outboard motor 100, an upper unit 101, a middle unit 102, and a lower unit 103 are sequentially arranged from the upside to the downside. In the upper unit 101, the engine 10 is vertically installed in and supported by an engine holder 11 such that a crankshaft 12 is directed to a vertical direction. As the engine 10, various engine types such as an in-line multi-cylinder engine may be employed. A cylinder block 14, a cylinder head 15, and a cylinder head cover 16 are sequentially assembled to a crankcase 13 that supports the crankshaft 12. In the engine 10, a plurality of cylinders having cylinder axes directed backward in a horizontal direction are arranged in a vertically overlapping manner. Further, the engine 10 is covered by the engine cover 101A.

The middle unit 102 is supported by upper and lower mounts 104 and 105 horizontally pivotably around a support shaft set in a swivel bracket 106. A clamp bracket 107 is provided in both sides of the swivel bracket 106, so that the middle unit 102 is fixed to the transom P of the ship hull using the clamp bracket 107. The swivel bracket 106 is supported vertically pivotably around a tilt shaft 108 set in the left and right direction.

In the middle unit 102, a drive shaft 109 connected to a lower end portion of the crankshaft 12 of the engine 10 is arranged to vertically penetrate, so that a drive force of the drive shaft 109 is transmitted to a propeller shaft 111 arranged in a gear casing 110 of the lower unit 103. A shift rod 112 for shifting a gear position to forward or backward is arranged in front of the drive shaft 109 in parallel with the vertical direction. In addition, the middle unit 102 is also provided with an oil pan 113 for storing oil for lubricating the engine 10. Further, the middle unit 102 has a drive shaft housing 114 for housing the drive shaft 109.

In the lower unit 103, the gear casing 110 internally has a plurality of gear groups 117 and the like to rotatably drive the propeller 116 using the propeller shaft 115 by virtue of the drive force of the drive shaft 109. In the gear group 117, a gear provided in the drive shaft 109 extending downward from the middle unit 102 meshes with the gear of the gear casing 110 so as to finally rotate the propeller 116. However, a power transmission path of the gear group 117 in the gear casing 110 is switched, that is, shifted by performing a shift operation using the shift rod 112.

Figure 2:
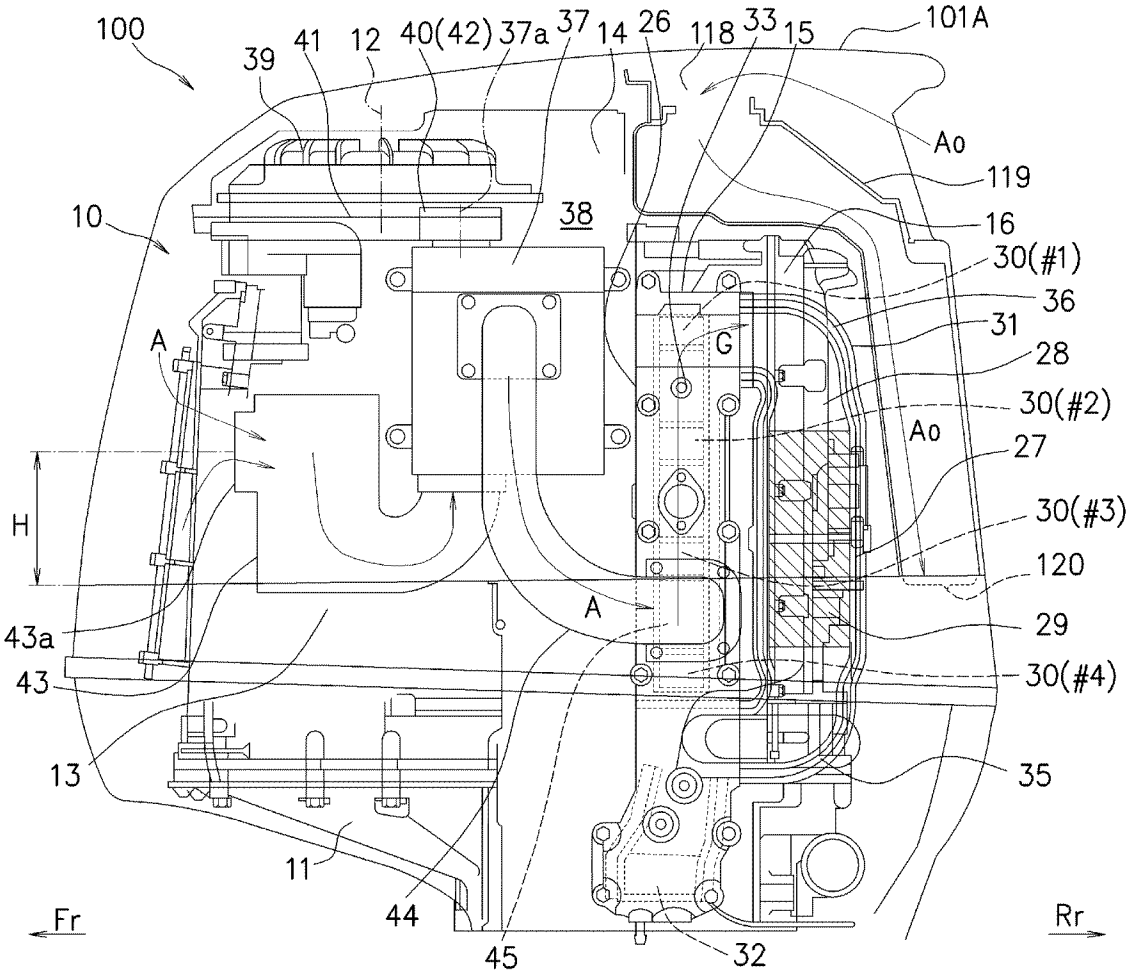
FIG. 2 is a left side view illustrating an engine of the outboard motor according to the first embodiment of the invention.
Figure 3:
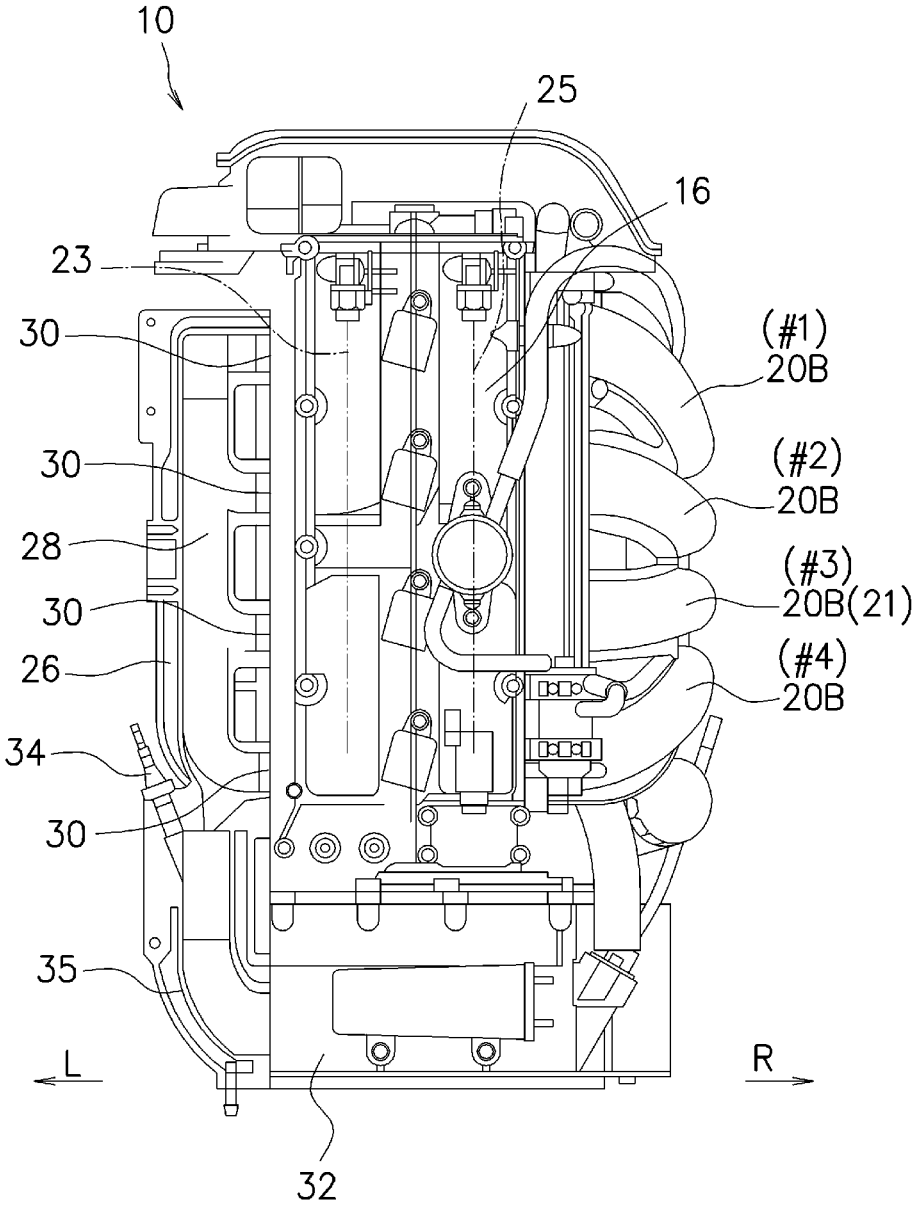
FIG. 3 is a rear front view illustrating the engine of the outboard motor according to the first embodiment of the invention.
Figure 4:
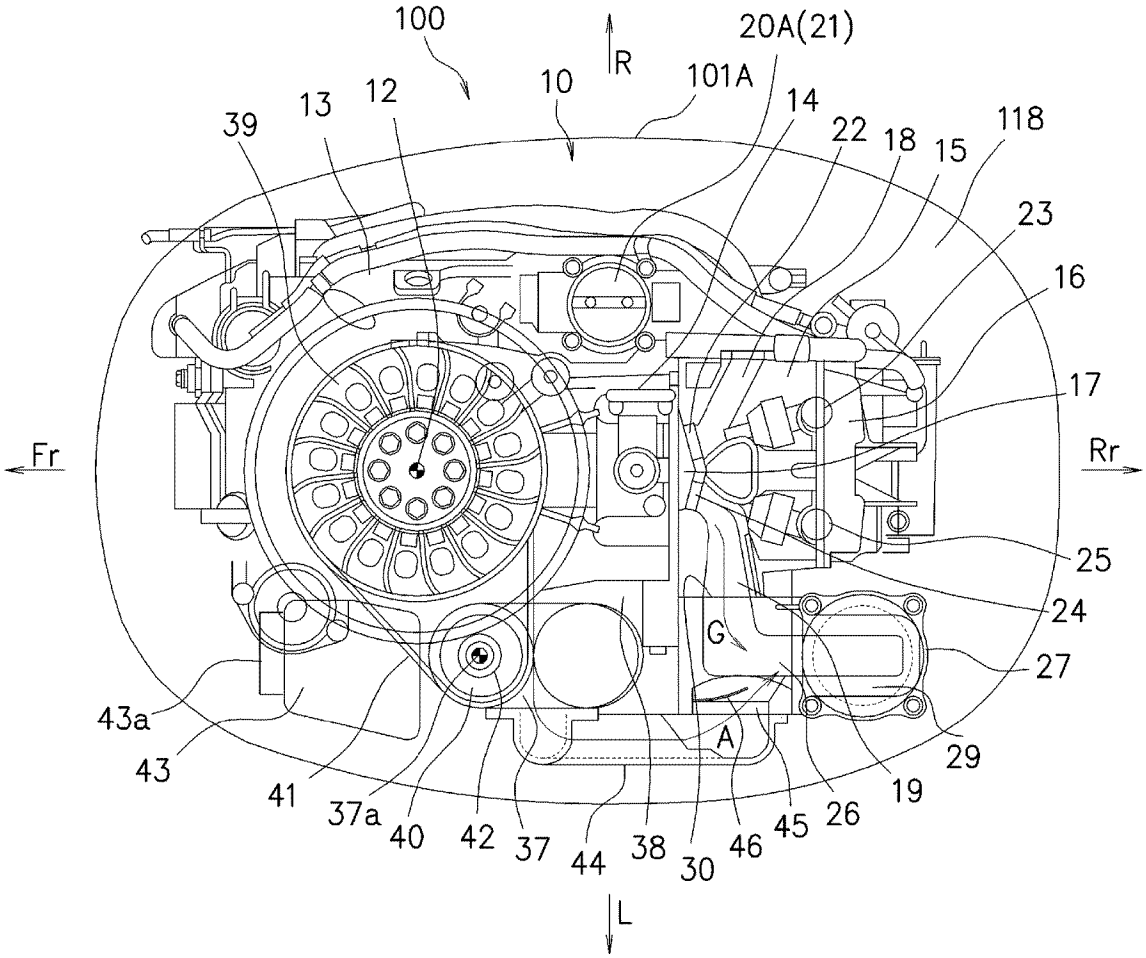
FIG. 4 is a top view illustrating the engine of the outboard motor according to the first embodiment of the invention.

FIGS. 2 to 4 illustrate an exemplary engine 10 according to this embodiment. FIG. 2 is a left side view illustrating the engine 10. FIG. 3 is a rear front view illustrating the engine 10. FIG. 4 is a top view illustrating the engine 10. It is assumed that the engine 10 of this embodiment is an in-line four-cylinder engine, in which four cylinders including the first cylinder #1, the second cylinder #2, the third cylinder #3, and the fourth cylinder #4 are sequentially arranged from the upside as illustrated in FIG. 3. The engine 10 is mounted onto the engine holder 11 in the fourth cylinder (#4) side such that the crankcase 13 is arranged in the front side, and the cylinder head 15 is arranged in the rear side. While the engine 10 will be described in brief with reference to FIGS. 2 to 4, some of components thereof may be appropriately omitted or not as necessary for simplicity purposes.

In the crankcase 13, the crankshaft 12 is supported by a plurality of journal bearings in its upper end, middle, and lower end portions rotatably inside the crankcase 13. The lower end of the crankshaft 12 may also be coupled to the upper end of the drive shaft 109, for example, by interposing a pair of coupling gears (reduction gears). As a result, the rotational force of the crankshaft 12 is transmitted to the drive shaft 109.

The cylinder block 14 is internally provided with cylinder bores for each cylinder, so that pistons are inwardly fitted to the cylinder bores in a reciprocatable manner (in this example, in the front-rear direction). The piston is connected to a crank pin of the crankshaft 12 by interposing a connecting rod. As a result, a reciprocating motion of the piston inside the cylinder bore is converted into a rotational motion of the crankshaft 12 and is transmitted to the drive shaft 109 as the output power of the engine 10.

Referring to FIG. 4, the cylinder head 15 is provided with combustion chambers 17 matching cylinder bores of each cylinder and intake and exhaust ports 18 and 19 communicating with respective combustion chambers 17. In this example, an intake system is arranged in the right side of the engine 10, and an exhaust system is arranged in the left side of the engine 10. First, in the intake system, the intake air flows into an intake manifold with a flow rate controlled by a throttle body 20A arranged in the right side of the cylinder block 14. This intake air is supplied to an intake port 18 via an intake branch 20B configured to branch the intake air to each cylinder from the intake manifold (refer to FIG. 3). The throttle body 20A, the intake branch 20B, the intake manifold, and the like constitute an intake system 21 for supplying combustion air to the engine 10. For the open/close operation of the intake port 18, a communicating portion to the combustion chamber 17 is controlled by an intake valve 22. In this case, the intake valve 22 is driven by a cam provided in an intake cam shaft 23 provided to vertically extend. In addition, for the open/close operation of the exhaust port 19 in the exhaust system, a communicating portion to the combustion chamber 17 is controlled by an exhaust valve 24. In this case, the exhaust valve 24 is driven by a cam provided in an exhaust cam shaft 25 provided to vertically extend. It is noted that, in this embodiment, each cylinder may have a four-valve structure having a pair of valves (intake valves 22 and exhaust valves 24) for the intake and exhaust sides, respectively.

On top of the combustion chamber 17 of each cylinder, an ignition plug is installed, so that a mixed gas supplied to the inside of the combustion chamber 17 is ignited by the ignition plug. Furthermore, the combustion gas exploded and combusted inside each cylinder bore of each cylinder is discharged from the exhaust port 19 to the exhaust manifold 26. In each cylinder, the exhaust manifold 26 provided in the outer side portion of the cylinder bore of the cylinder block 14 is connected to the exhaust port 19 to communicate with each other. As illustrated in FIGS. 2 and 3, the exhaust manifold 26 is provided to vertically extend on the left side face of the cylinder head 15 so that the exhaust gases from each exhaust port 19 are joined. The confluent exhaust gas passes through the exhaust manifold 26 and is finally guided to the lower side of the engine 10 as described below. Then, the exhaust gas passes through an exhaust passage formed inside the engine holder 11 and is finally discharged to the water.

As an exemplary structure of the engine 10 according to this embodiment, a catalyst is installed in the middle of the exhaust passage of the exhaust system. As illustrated in FIG. 2, an exhaust passage 28 is formed to extend from the exhaust manifold 26 via the catalyst housing portion 27 to the middle and lower units 102 and 103 provided in the lower part of the engine 10. The catalyst housing portion 27 is provided to extend vertically in parallel with the exhaust manifold 26 behind the exhaust manifold 26 and internally houses the catalyst 29. The exhaust manifold 26 included in a part of the exhaust passage 28 is provided with a plurality of openings 30 (in this example, four openings) connected to the exhaust ports 19 of each cylinder. In addition, the upper parts of the exhaust manifold 26 and the catalyst housing portion 27 are connected to each other through a connection passage 31. Furthermore, the exhaust passage 28 extends downward while it is curved under the catalyst housing portion 27 and is connected to an exhaust communicating passage 32 formed inside the engine holder 11, so that the exhaust passage 28 communicates with the middle unit 102 through the exhaust communicating passage 32.

In this manner, the exhaust passage 28 includes the exhaust manifold 26, the connection passage 31, the catalyst housing portion 27, and the exhaust communicating passage 32. In the middle of the exhaust passage 28, oxygen concentration sensors 33 and 34 for detecting an oxygen concentration of the exhaust gas are installed in an exhaust upstream side and an exhaust downstream side, respectively, of the catalyst housing portion 27 that houses the catalyst 29. Specifically, the oxygen concentration sensors 33 and 34 are installed in a suitable region of the exhaust manifold 26 and a suitable region of an extension 35 extending from the lower side of the catalyst housing portion 27, respectively (refer to FIGS. 2 and 3). The oxygen concentration sensors 33 and 34 are capable of detecting an oxygen concentration of the exhaust gas in the vicinity of their installed regions. In addition, a water jacket 36 is provided in the outer circumferential portion of the passage generally along the entire length of the exhaust passage 28. As a result, a coolant sent from a water pump of a cooling system is circulated through the inside of the water jacket 36 to cool the exhaust passage 28.

Here, in the engine 10, the crankcase 13, the cylinder block 14, the cylinder head 15, and the cylinder head cover 16 generally constitute an engine body. An intake system 21 for supplying combustion air to the engine body is arranged in one side of the left or right side of the engine body, that is, in the right side in this example. In addition, an exhaust passage 28 for discharging the combustion gas from the engine body is arranged in the other side of the left or right side of the engine body, that is, in the left side in this example.

In the exhaust system, the exhaust gases discharged from the exhaust ports 19 of each cylinder flow into the opening 30 of the exhaust manifold 26 and are joined inside the exhaust manifold 26 (in FIGS. 2 to 4, the arrow G denotes the flow of the exhaust gas as necessary). The confluent exhaust gas flows upward inside the exhaust manifold 26 and flows into the catalyst housing portion 27 through the connection passage 31 in an upper part thereof. The exhaust gas further passes through the catalyst 29 inside the catalyst housing portion 27 and flows into the extension 35 from the lower part of the catalyst housing portion 27. Then, the exhaust gas passes through the exhaust communicating passage 32 inside the engine holder 11 and is discharged to the water through the middle unit 102 and the lower unit 103.

According to the present invention, an air pump 37 configured to supply secondary air to the upstream side of the catalyst 29 is further provided in the exhaust passage 28. This air pump 37 supplies the secondary air to the exhaust gas flowing through the exhaust passage 28 in order to purify the exhaust gas, that is, supplies oxygen necessary to oxidize and detoxify hydrocarbons and carbon monoxides in the exhaust system. That is, oxidization of the exhaust gas is promoted by reacting oxygen with the exhaust gas, and a discharge amount of hydrocarbons and carbon monoxides is reduced.

According to this embodiment, the air pump 37 is arranged in the other side of the left or right side of the engine body (in this example, in the left side), that is, in the same side as that of the exhaust passage 28. As a type of the compressor employed in the air pump 37, a root type, a Lysholm type, a centrifugal type, and the like are known in the art, and any type of pumps may be suitably employed. In this example, as illustrated in FIGS. 2 and 4, the air pump 37 is arranged in a front side of the engine body relative to the exhaust manifold 26. A rotation shaft 37*a* of the air pump 37 may be set in a vertical direction. The air pump 37 is tightly fixed to a side wall of the cylinder block 14 by a bolt and the like in a concave portion 38 (FIG. 4) on a side face of the cylinder block 14 spanning across the #1 to #2 cylinders.

The power of the engine 10 may be used as a power source of the air pump 37, and a power transmission device connected to the crankshaft 12 to drive the air pump 37 is provided. In this example, as a power transmission device, a flywheel 39 (side) coupled to the crankshaft 12 and a pulley 40 installed in a rotation shaft 37*a* of the air pump 37 are connected by looping a belt 41. In this manner, the air pump 37 is rotatably driven by using the driving force of the crankshaft 12. However, in this case, power transmission therebetween may be controlled. For example, a clutch mechanism, specifically, an electromagnetic clutch 42 is assembled to a mount portion of the pulley 40 of the rotation shaft 37*a* of the air pump 37. Using the electromagnetic clutch 42, connection/disconnection of power transmission of the driving force from the crankshaft 12 to the air pump 37 is controlled. Here, since the fuel supplied to the engine 10 becomes rich in the event of acceleration of the outboard motor 100 and the like, an oxygen concentration of the exhaust gas becomes thin. Therefore, activity of the catalyst 29 in the exhaust passage 28 is reduced naturally. In this example, the air pump 37 is driven and controlled to supply the secondary air to the exhaust gas on the basis of an oxygen concentration detection value of the oxygen concentration sensor 34 provided in the downstream side of the exhaust system in order to maintain activity of the catalyst 29. In this case, the oxygen concentration detection value of the oxygen concentration sensor 34 is transmitted to an electronic control unit (ECU) mounted to the outboard motor 100. The ECU operates the electromagnetic clutch 42, that is, controls driving of the air pump 37 depending on whether or not the oxygen concentration of the exhaust gas is equal to or higher than a predetermined threshold value on the basis of the oxygen concentration information.

An air inlet 43 for receiving the secondary air is connected to the air pump 37, and the secondary air is supplied from the air inlet 43 to the air pump (in FIG. 2, the arrow A denotes a flow of the secondary air). The air inlet 43 is arranged in a lateral side of the crankcase 13 closely to the front side of the air pump 37 and has a generally cavity structure. In addition, an inlet duct 43*a* for receiving the air is opened in a front end of the air inlet 43, as illustrated in FIG. 2. The air inlet 43 has a gas-liquid separation capability and a sound muffling capability for the received air. Further, the air inlet 43 may be embedded with an air filter, and as a result, the secondary air blowing to the air pump 37 is purified. Here, the engine 10, the intake system, and the exhaust system are housed in the engine housing 118 covered by the engine cover 101A (cowling). An external air guide unit for guiding the external air to the inside of the engine housing 118, specifically, an external air intake duct 119 is provided as illustrated in FIG. 2. In the vicinity of the bottom of the external air intake duct 119, an inflow port 120 for receiving the air guided from the external air intake duct 119 is opened in a rear part of the engine housing 118 behind the engine body (in FIG. 2, the arrow $A_o$ denotes a flow of the air guided to the inside of the engine housing 118). The intake duct 43*a* of the air inlet 43 is set vertically higher than the inflow port 120 of the external air intake duct 119 in a front part of the engine housing 118 (in FIG. 2, height H).

According to this embodiment, the air pump 37 and the exhaust manifold 26 as a part of the exhaust passage 28 are connected to each other by interposing a secondary air supply passage 44. The secondary air supply passage 44 extends downward from the left side face of the air pump 37, is curved to the rear side, and then extends to the left side face of the exhaust manifold 26. A leading end portion of the secondary air supply passage 44 is opened for connection to the exhaust manifold 26. The connecting portion 45 of the exhaust passage 28 for connection to the secondary air supply passage 44 is provided in an upstream side of the exhaust flow direction relative to the catalyst housing portion 27, and particularly, in this example, in the most upstream side of the exhaust flow direction in the exhaust manifold 26 (a region approximately matching the #4 cylinder). A reed valve 46 (check valve) is installed in the connecting portion 45 as illustrated in FIG. 4. The reed valve 46 prevents a reverse flow of the exhaust gas from the exhaust passage 28 to the air pump 37.

As described above, in the exhaust system, the exhaust gases discharged from the exhaust ports 19 of each cylinder flow to the opening 30 of the exhaust manifold 26 and are joined inside the exhaust manifold 26. The confluent exhaust gas flows to the catalyst housing portion 27 through the connection passage 31. As the exhaust gas passes through the catalyst 29 inside the catalyst housing portion 27, hydrocarbons, carbon monoxides, and nitrogen oxides predominantly contained in the exhaust gas are oxidized or reduced. As a result, hazardous substances of the exhaust gas are removed, that is, the exhaust gas is purified. For efficient oxidization or reduction, it is necessary to set a theoretical air-fuel ratio by which the fuel and the air are perfectly combusted, and no oxygen remains. An oxygen concentration of the exhaust gas is monitored by an oxygen concentration sensor 33 and 34 at all times. The ECU operates the electromagnetic clutch 42 and drives the air pump 37 on the basis of the oxygen concentration detection value. By supplying the secondary air to the exhaust gas using the air pump 37, it is possible to maintain activity of the catalyst 29 at all times and effectively purify the exhaust gas.

According to the present invention, in particular, the intake system 21 is arranged in one side of the left or right side of the engine body (in this example, in the right side), and the exhaust passage 28 and the air pump 37 are arranged in the other side of the left or right side of the engine body (in this example, in the left side).

In this way, by arranging the intake system 21 in the right side and arranging the exhaust passage 28 and the air pump 37 in the left side of the engine body in a dividing manner, it is possible to compactly set the width of the engine 10 of the outboard motor 100, particularly, in the left and right direction. For example, in particular, when a plurality of outboard motors 100 is mounted on a transom P of a ship hull, it is possible to reduce an arrangement interval between the outboard motors 100 in the left and right direction. If the arrangement interval of the outboard motor 100 is large, the outboard motor arranged in the outer side easily floats up during a turn, and this may generate cavitation and the like. According to the present invention, it is possible to reduce the arrangement interval of the outboard motor 100. Therefore, it is possible to prevent reduction of the propulsion force caused by cavitation and anticipate improvement of control stability of a ship or other effects.

The exhaust passage is provided with the exhaust manifold 26, the catalyst housing portion 27 arranged in parallel with the exhaust manifold 26 to house the catalyst 29, and the connection passage 31 for connecting the exhaust manifold 26 and the catalyst housing portion 27. The catalyst housing portion 27 is arranged in a rear side of the engine body relative to the exhaust manifold 26, and the air pump 37 is arranged in a front side of the engine body relative to the exhaust manifold 26. In addition, in this example, the connecting portion 45 for connection from the air pump 37 to the secondary air supply passage 44 is provided in the exhaust manifold 26 and is connected to the secondary air supply passage 44 in the upstream side of the exhaust flow direction relative to the catalyst housing portion 27.

By arranging the catalyst housing portion 27, the air pump 37, and the secondary air supply passage 44 in the exhaust system in a dividing manner along the front-rear direction, they are not overlapped in the left and right direction. In this manner, since any one of the plurality of members is not arranged to excessively protrude in the left and right direction, it is possible to compactly set the width of the engine 10 in the left and right direction.

The air pump 37 is connected to the crankshaft 12 by interposing a power transmission device, and the power transmission device has a clutch mechanism capable of controlling transmission of the driving force of the crankshaft 12.

Since the driving of the air pump 37 can be controlled as necessary, it is possible to optimally adjust the supply amount of the secondary air depending on a driving state of the engine 10. As a result, it is possible to ensure optimum activity of the catalyst 29 and improve durability. In addition, by avoiding unnecessary operation of the air pump 37, it is possible to reduce a loss in the output power of the engine 10 and anticipate improvement of the fuel efficiency.

In the engine housing 118 covered by the engine cover 101A, the intake duct 43*a* of the air inlet 43 is positioned vertically higher than the inflow port 120 of the external air intake duct 119 in a front part of the engine housing 118.

By arranging the intake duct 43*a* in this way, it is possible to effectively prevent water from mixing with the secondary air supplied to the exhaust passage 28 by the air pump 37 and guarantee a purification effect of the exhaust gas using the secondary air.

<Second Embodiment>

Figure 5:
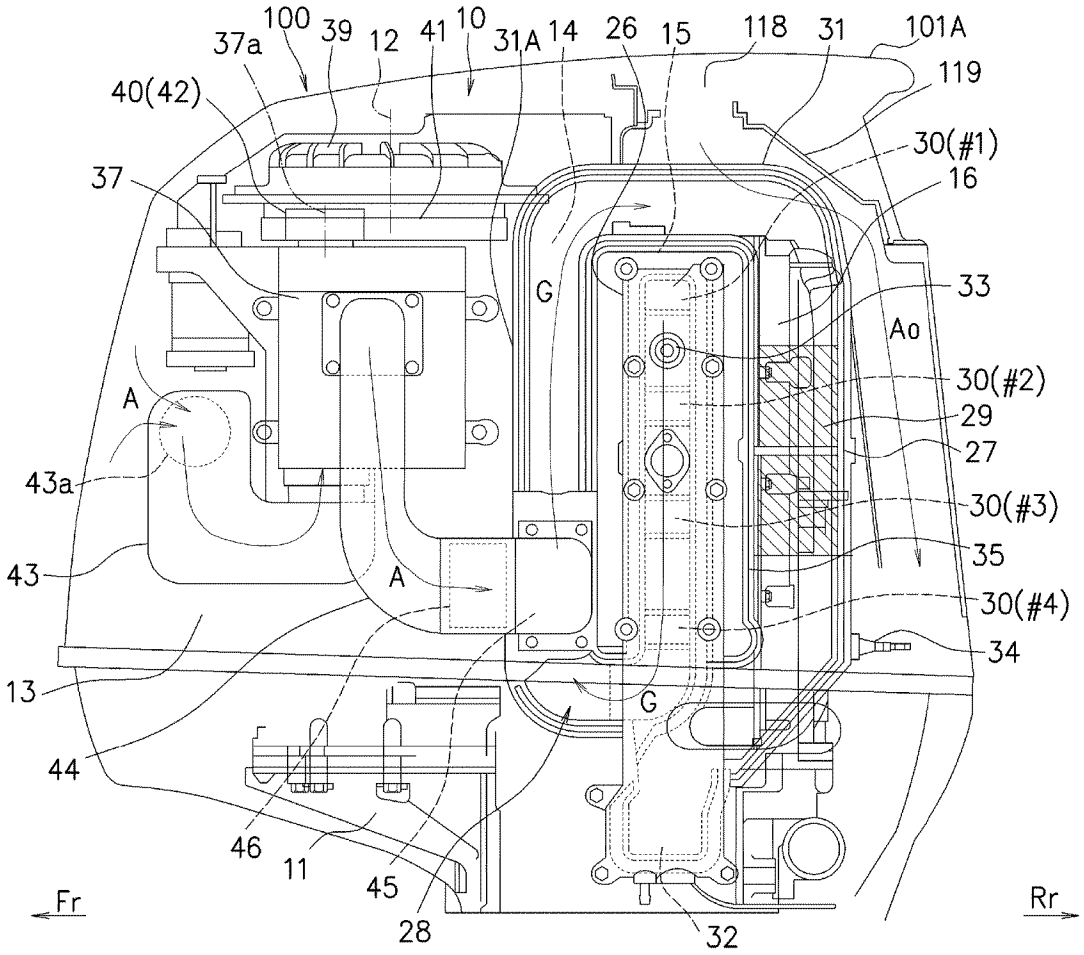
FIG. 5 is a left side view illustrating an engine of an outboard motor according to a second embodiment of the invention.
Figure 6:
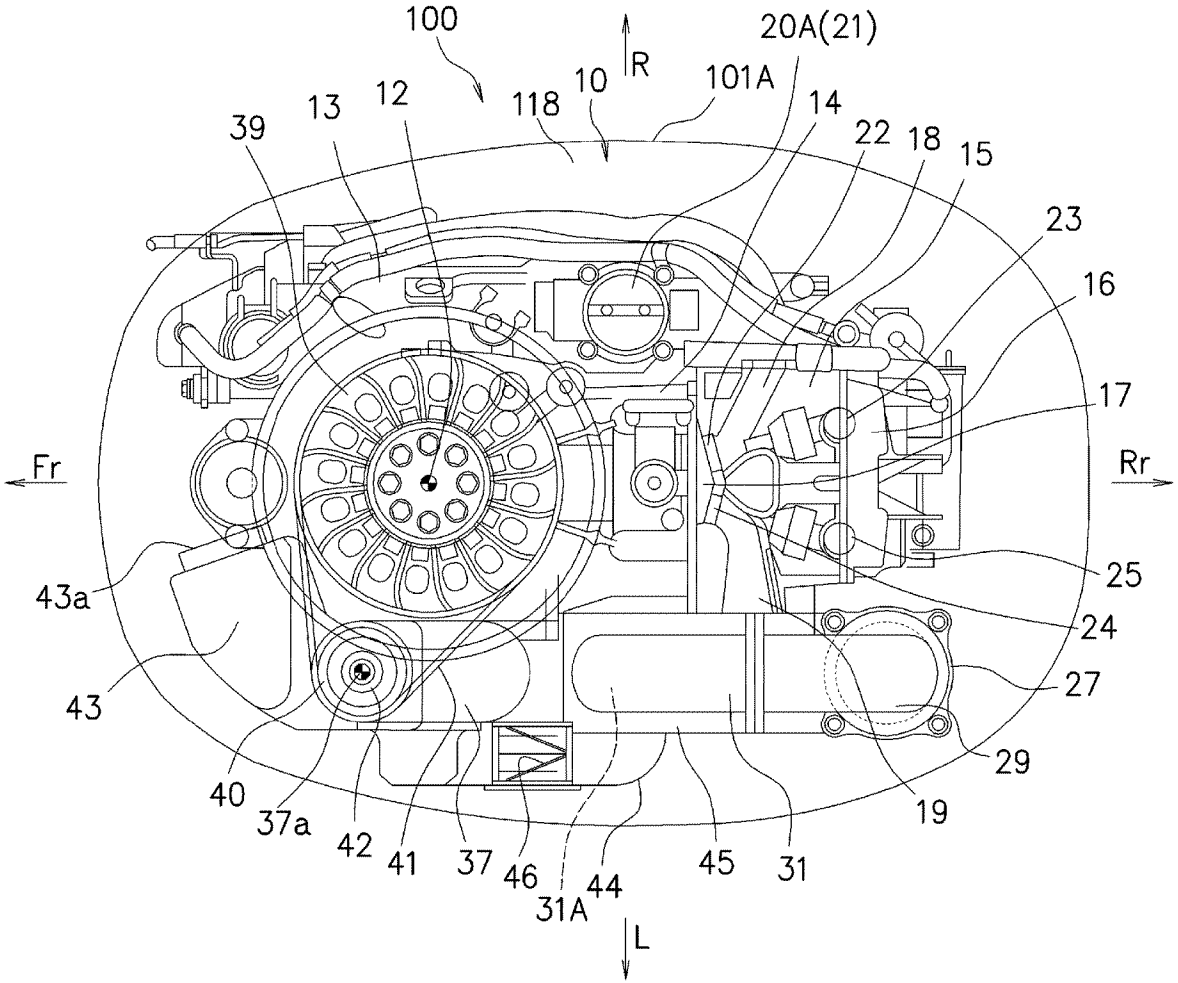
FIG. 6 is a top view illustrating the engine of the outboard motor according to the second embodiment of the invention.

Next, an engine for an outboard motor according to a second embodiment of the invention will be described. FIG. 5 is a left side view illustrating an engine 10 according to the second embodiment, and FIG. 6 is a top view illustrating the engine 10. In FIGS. 5 and 6, like reference numerals denote like elements as in the first embodiment. As illustrated in FIG. 5, in a side view of the engine 10, the exhaust passage 28 including the exhaust manifold 26, the connection passage 31, the catalyst housing portion 27, and the extension 35 thereof is arranged in a swirling manner (helical shape), and the exhaust manifold 26 is interposed between the connection passage 31 and the catalyst housing portion 27 in the front-rear direction. That is, the connection passage 31 for connecting the exhaust manifold 26 and the catalyst housing portion 27 in the exhaust passage 28 has an upright portion 31A that extends upward from a lower part of the exhaust manifold 26 and is then connected to the top of the catalyst housing portion 27 as illustrated in FIG. 5.

The intake system 21 is arranged in one side of the left or right side of the engine body (in this example, in the right side), and the exhaust passage 28 and the air pump 37 are arranged in the other side of the engine body (in this example, in the left side).

In the exhaust system of the engine 10 according to the second embodiment, the exhaust gases discharged from the exhaust ports 19 of each cylinder flow into the opening 30 of the exhaust manifold 26 and are joined inside the exhaust manifold 26 (in FIG. 5, the arrow G denotes a flow of the exhaust gas). The confluent exhaust gas flows downward inside the exhaust manifold 26 and flows to the connection passage 31 in the lower part thereof. The exhaust gas flows upward inside the upright portion 31A of the connection passage 31 and then flows into the catalyst housing portion 27. The exhaust gas passes through the catalyst 29 in this course.

As illustrated in FIGS. 5 and 6, the air pump 37 is arranged in a front side of the engine body relative to the exhaust manifold 26 in front of the upright portion 31A. In this example, the connecting portion 45 for connection from the air pump 37 to the secondary air supply passage 44 is provided in the connection passage 31. That is, the connecting portion 45 is connected to the secondary air supply passage 44 in the upstream side of the exhaust flow direction relative to the catalyst housing portion 27. In this case, the connecting portion 45 is set approximately in the most upstream side of the connection passage 31 in the exhaust flow direction. Furthermore, the reed valve 46 is installed in the secondary air supply passage 44 directly in front of the connecting portion 45 (in the upstream side of the secondary air flow direction).

According to the second embodiment of the invention, the secondary air is supplied from the air pump 37 to the exhaust gas flowing through the exhaust passage 28 through the connecting portion 45 in order to supply oxygen necessary to oxidize and detoxify hydrocarbons and carbon monoxides in the exhaust system. As a result, by reacting oxygen with the exhaust gas, it is possible to promote oxidization of the exhaust gas and reduce the discharge amount of hydrocarbons and carbon monoxides.

According to the second embodiment, in particular, since the upright portion 31A is provided in the connection passage 31, it is possible to increase the length of the connection passage 31. In this case, the connecting portion 45 is set approximately in the most upstream side of the upright portion 31A of the connection passage 31 in the exhaust flow direction. As a result, it is possible to increase the size of the space for mixing the exhaust gas and the secondary air. In this manner, by increasing the length and size of the space for mixing the exhaust gas and the secondary air, it is possible to more regularly mix the exhaust gas and the secondary air and promote suitable reaction between the gas and the catalyst 29.

It is noted that, according to the second embodiment of the invention, the intake duct 43*a* of the air inlet 43 is set vertically higher than the inflow port 120 of the external air intake duct 119 in a front part of the engine housing 118 (refer to FIG. 2). By arranging the intake duct 43*a* in such a high position, it is possible to effectively prevent water from mixing with the secondary air supplied to the exhaust passage 28 by the air pump 37 and guarantee a purification effect of the exhaust gas using the secondary air.

<Third Embodiment>

Figure 7:
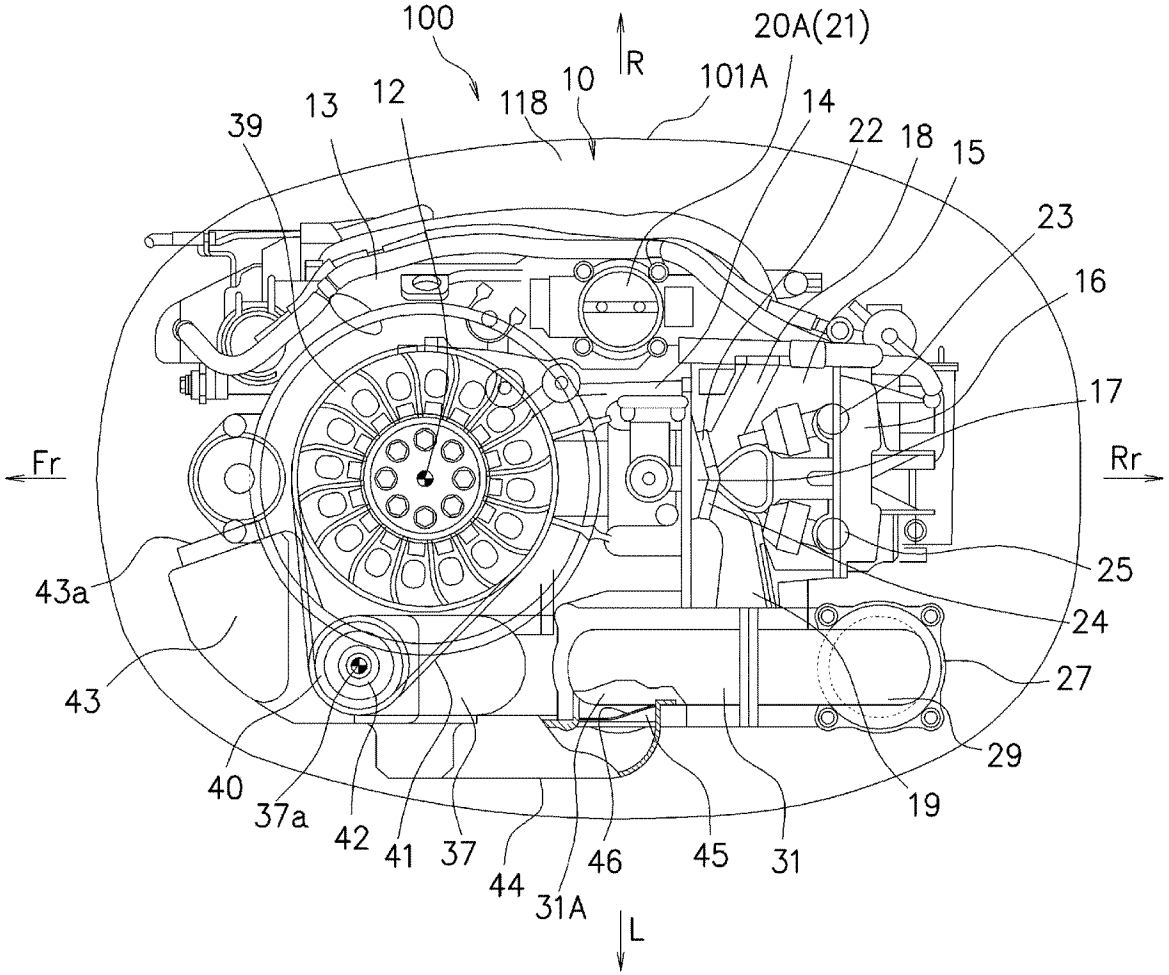
FIG. 7 is a top view illustrating an engine of an outboard motor according to a third embodiment of the invention.

Next, an engine for an outboard motor according to a third embodiment of the invention will be described. FIG. 7 is a top view illustrating an engine 10 according to the third embodiment. Referring to FIG. 7, a basic configuration according to the third embodiment is substantially similar to that of the second embodiment. The connection passage 31 has an upright portion 31A extending upward from a lower part of the exhaust manifold 26. In this case, the connecting portion 45 is set approximately in the most upstream side of the upright portion 31A of the connection passage 31 in the exhaust flow direction.

The intake system 21 is arranged in one side of the left or right side of the engine body (in this example, in the right side), and the exhaust passage 28 and the air pump 37 are arranged in the other side of the engine body (in this example, in the left side).

According to the third embodiment of the invention, in particular, the reed valve 46 is installed in the connecting portion 45 as illustrated in FIG. 7. Compared to a case where the reed valve 46 is installed in the middle of the secondary air supply passage 44, an installation work becomes easy. In addition, it is possible to improve maintainability for the reed valve 46 itself or neighboring parts thereof.

It is noted that, according to the third embodiment of the invention, the intake duct 43*a* of the air inlet 43 is set vertically higher than the inflow port 120 of the external air intake duct 119 in a front part of the engine housing 118 (refer to FIG. 2). By arranging the intake duct 43*a* in such a high position, it is possible to effectively prevent water from mixing with the secondary air supplied to the exhaust passage 28 by the air pump 37 and guarantee a purification effect of the exhaust gas using the secondary air.

<Fourth Embodiment>

Figure 8:
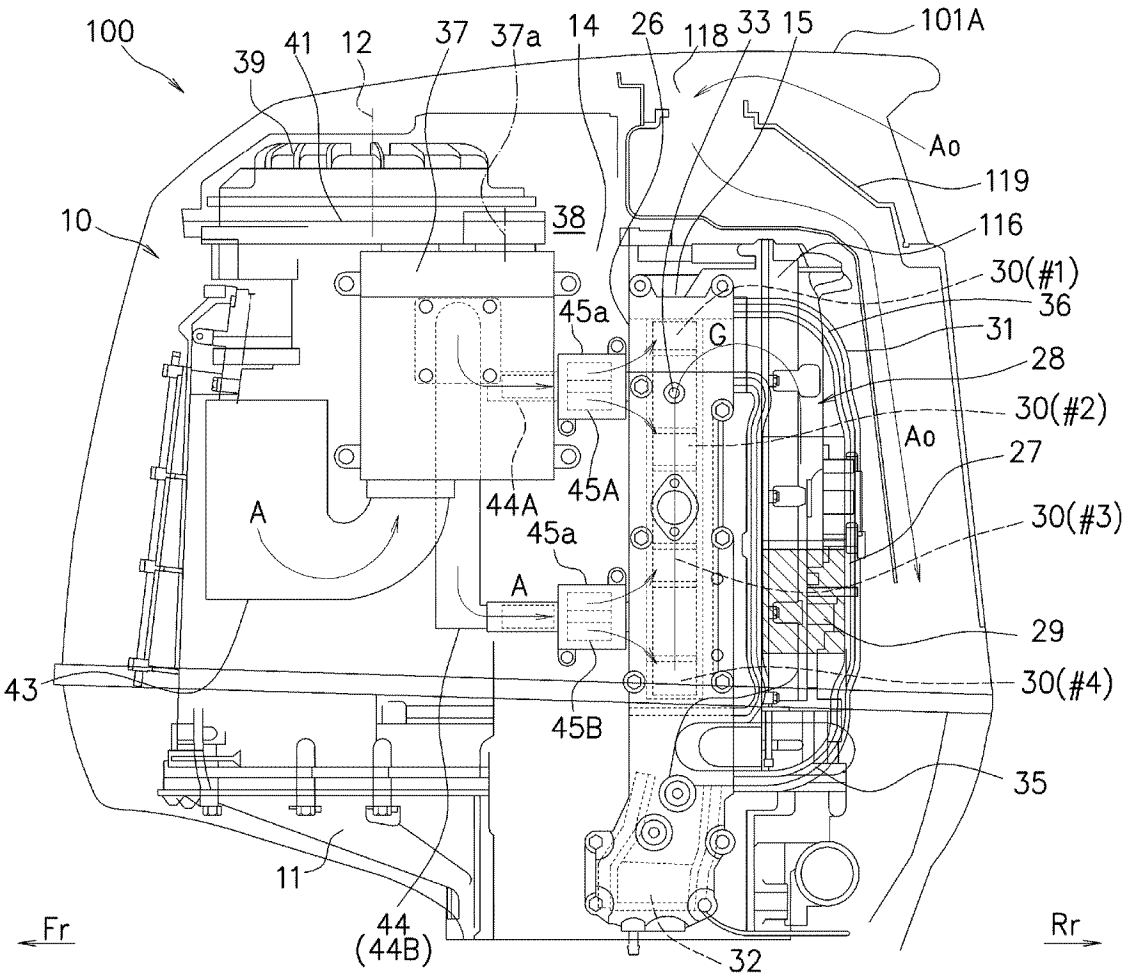
FIG. 8 is a left side view illustrating an engine of an outboard motor according to a fourth embodiment of the invention.
Figure 9:
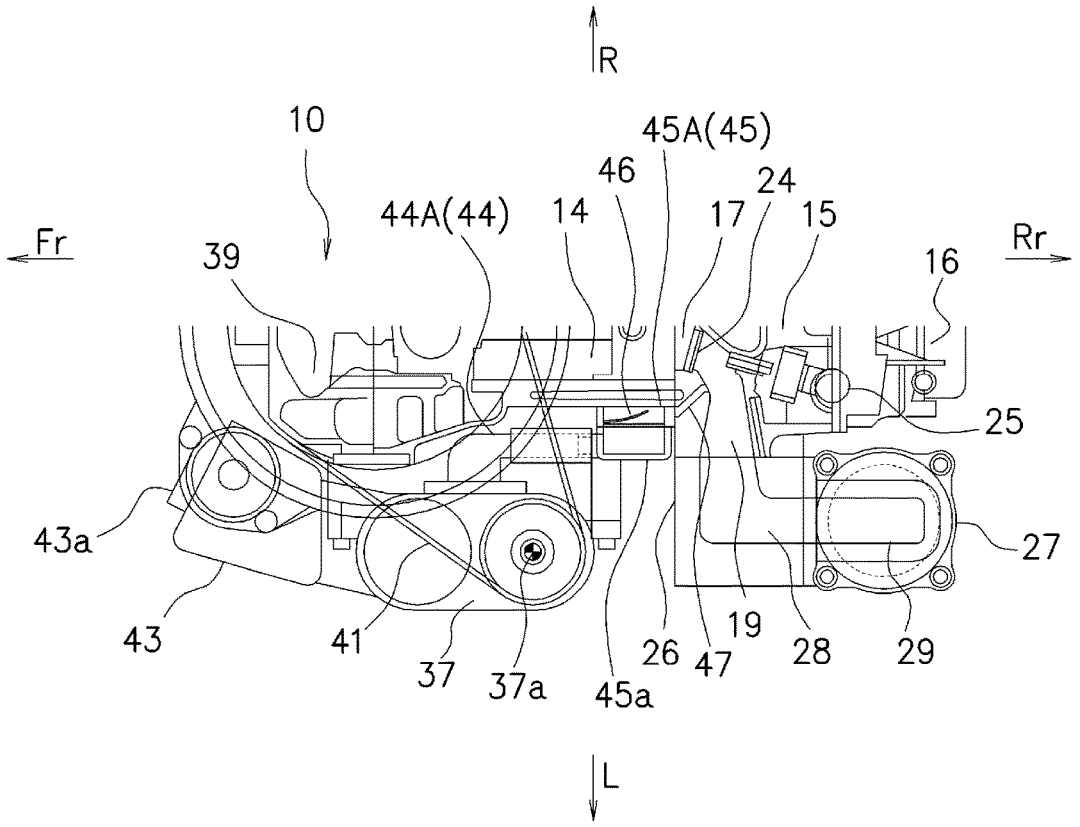
FIG. 9 is a top view illustrating the engine of the outboard motor according to the fourth embodiment of the invention.

Next, an engine for an outboard motor according to a fourth embodiment of the invention will be described. FIG. 8 is a left side view illustrating an engine 10 according to the fourth embodiment, and FIG. 9 is a top view illustrating the left side of the engine 10. According to the fourth embodiment, a basic configuration of the surroundings of the connection passage 31 is substantially similar to that of the first embodiment. In FIGS. 8 and 9, like reference numerals denote like elements as in the first embodiment. The catalyst housing portion 27 is installed in a rear side of the exhaust manifold 26 to extend in a vertical direction in parallel with the exhaust manifold 26 and houses the catalyst 29.

The intake system 21 is arranged in one side of the left or right side of the engine body (in this example, in the right side), and the exhaust passage 28 and the air pump 37 are arranged in the other side of the left or right side of the engine body (in this example, in the left side).

In the exhaust system, the exhaust gases discharged from the exhaust ports 19 of each cylinder flow to the opening 30 of the exhaust manifold 26 and are joined inside the exhaust manifold 26. The confluent exhaust gas flows upward inside the exhaust manifold 26 and flows into the catalyst housing portion 27 through the connection passage 31 in an upper part thereof. Furthermore, the exhaust gas passes through the catalyst 29 of the catalyst housing portion 27 and flows into the extension 35 from a lower part of the catalyst housing portion 27. Then, the exhaust gas passes through the exhaust communicating passage 32 inside the engine holder 11 and flows to the middle unit 102 and further the lower unit 103. Then, the exhaust gas is discharged to the water.

According to the fourth embodiment of the invention, in particular, the connecting portion 45 of the secondary air supply passage 44 is formed integrally with the cylinder block 14 included in the engine body, and the communicating passage 47 is provided to communicate with each exhaust port 19 of each cylinder. In this case, the secondary air supply passage 44 extending from the right side face of the air pump 37 branches into two separate ways, and the branching secondary air supply passages 44A and 44B are connected to the connecting portions 45A and 45B, respectively. Each connecting portion 45A and 45B is formed integrally with the cylinder block 14 and is installed with the reed valve 46. Further, each connecting portion 45A and 45B is installed with a cover 45*a* to cover the reed valve 46. The secondary air discharge side of each reed valve 46 and the exhaust port 19 are connected to each other by interposing the communicating passage 47.

It is noted that, according to the fourth embodiment, the intake duct 43*a* of the air inlet 43 is set vertically higher than the inflow port 120 of the external air intake duct 119 in a front part of the engine housing 118 (refer to FIG. 2). By arranging the intake duct 43*a* in such a high position, it is possible to effectively prevent water from mixing with the secondary air supplied to the exhaust passage 28 by the air pump 37 and guarantee a purification effect of the exhaust gas using the secondary air.

According to the fourth embodiment of the invention, the secondary air from the air pump 37 is supplied to the connecting portions 45A and 45B through the secondary air supply passages 44A and 44B, respectively. In each of the connecting portions 45A and 45B, the secondary air output from the reed valve 46 is discharged to the inside of the exhaust port 19 through the communicating passage 47 so that the secondary air is supplied to the exhaust gas.

According to the fourth embodiment of the invention, in particular, the catalyst housing portion 27, the exhaust manifold 26, and the secondary air supply passage 44 are arranged not to overlap in the left and right direction of the engine 10. Therefore, it is possible to compactly set the width of the engine 10 along the left and right direction.

While preferred embodiments of the invention have been described and illustrated hereinbefore, it should be understood that they are only for exemplary purposes and are not to be construed as limitations. Any addition, omission, substitution, or modification may be possible without departing from the spirit or scope of the present invention.

Although the engine 10 is an in-line four-cylinder engine in the embodiments described above, the number of cylinders of the engine 10 may change.

According to the invention, the intake system is arranged in one side, and the exhaust passage and the air pump are arranged in the other side of the engine body in a dividing manner along the left and right direction. Therefore, it is possible to compactly set the width of the engine of the outboard motor in the left and right direction. In this case, in the exhaust system, the catalyst housing portion, the air pump, and the secondary air supply passage are arranged to deviate in the front-rear direction. Similarly, from this standpoint, it is possible to compactly set the width of the engine in the left and right direction.

What is claimed is:

1. An engine for an outboard motor comprising:

an in-line multiple-cylinder engine body provided with a crankshaft having an axial line directed to a vertical direction and a plurality of vertically overlapping cylinders, the cylinders having axial lines directed backward in a horizontal direction;

an intake system configured to supply combustion air to the engine body;

an exhaust passage formed to connect the engine body and middle and lower units thereunder;

a catalyst provided in the exhaust passage; and an air pump configured to supply secondary air to an upstream side of the catalyst in the exhaust passage, wherein the intake system is arranged in a side portion of one side of the left or right side of the engine body, wherein the exhaust passage and the air pump are arranged in a side portion of the other side of the left or right side of the engine body, wherein the air pump is connected to the crankshaft by interposing a power transmission device and is driven by the crankshaft, and wherein the power transmission device comprises a clutch mechanism controlling transmission of a driving force.

2. The engine for an outboard motor according to claim 1, wherein the exhaust passage comprises:

an exhaust manifold that is connected to exhaust ports provided in each cylinder of the engine body and extends in a vertical direction, a catalyst housing portion arranged in parallel with the exhaust manifold to house the catalyst, and a connection passage configured to connect the exhaust manifold and the catalyst housing portion, wherein the air pump is arranged in a front side of the engine body relative to the exhaust manifold and the catalyst housing portion, and a connecting portion connecting the air pump to the secondary air supply passage is provided in any one of the exhaust ports of each cylinder, the exhaust manifold, and the connection passage and is connected to the secondary air supply passage in an upstream side relative to the catalyst housing portion in an exhaust flow direction.

3. The engine for an outboard motor according to claim 2, wherein the catalyst housing portion is arranged in a rear side of the engine body relative to the exhaust manifold.

4. The engine for an outboard motor according to claim 2, wherein the connecting portion of the secondary air supply passage is formed integrally with the cylinder block included in the engine body and is provided with a communicating passage communicating with each exhaust port of each cylinder.

5. The engine for an outboard motor according to claim 2, wherein a connecting portion of the exhaust passage connecting to the secondary air supply passage is formed in the most upstream side of the exhaust manifold in the exhaust flow direction.

6. The engine for an outboard motor according to claim 2, wherein the connection passage connecting the exhaust manifold of the exhaust passage and the catalyst housing portion has an upright portion that extends upward from a lower part of the exhaust manifold and is connected to a top portion of the catalyst housing portion, and a connecting portion connecting to the secondary air supply passage is formed approximately in the most upstream side of the connection passage in the exhaust flow direction.

7. The engine for an outboard motor according to claim 1, wherein the engine body and the intake and exhaust systems thereof are housed in an engine housing covered by an engine cover, an opening of an external air guide unit receiving external air to the inside of the engine housing is provided behind the engine body in a rear part of the engine housing, and an inlet port of the air pump is set vertically higher than an opening of the external air guide unit in a front part of the engine housing.

* * * * *